US011598614B1

(12) United States Patent
Godsey

(10) Patent No.: US 11,598,614 B1
(45) Date of Patent: Mar. 7, 2023

(54) ALUMINUM LIGHTED NOCK WITH AN EXTERNAL SWITCH

(71) Applicant: Samuel W. Godsey, Plymouth, WI (US)

(72) Inventor: Samuel W. Godsey, Plymouth, WI (US)

( * ) Notice: Subject to any disclaimer, the term of this patent is extended or adjusted under 35 U.S.C. 154(b) by 114 days.

(21) Appl. No.: 17/316,855

(22) Filed: May 11, 2021

Related U.S. Application Data

(60) Continuation-in-part of application No. 29/693,641, filed on Jun. 4, 2019, which is a division of application No. 15/972,260, filed on May 7, 2018, now abandoned, which is a continuation-in-part of application No. 15/196,501, filed on Jun. 29, 2016, now Pat. No. 10,001,353.

(60) Provisional application No. 62/190,896, filed on Jul. 10, 2015.

(51) Int. Cl.
*F42B 6/06* (2006.01)
*H01H 9/16* (2006.01)

(52) U.S. Cl.
CPC ..... *F42B 6/06* (2013.01); *H01H 9/161* (2013.01)

(58) Field of Classification Search
CPC ..... H01H 9/161; F42B 12/362
See application file for complete search history.

(56) References Cited

U.S. PATENT DOCUMENTS 6,123,631 A * 9/2000 Ginder ..... F42B 12/382 473/578
9,618,304 B2 4/2017 Pedersen et al.
2009/0097239 A1* 4/2009 Lynch ..... F21V 33/008 362/202
2011/0312453 A1* 12/2011 Chu ..... F42B 6/06 473/570
2013/0267359 A1* 10/2013 Pedersen ..... F42B 6/06 473/578
2014/0121045 A1* 5/2014 Minica ..... F42B 6/06 473/570
2015/0308798 A1* 10/2015 Kim ..... F42B 6/06 473/570

OTHER PUBLICATIONS

Tenpoint Crossbow ALPHA Nock, Metal as described by https://farmsteadoutdoors.com/product/tenpoint-crossbow-alpha-nock-replacement-6pk-metal-hea-352-6m-ten-point/.
Electron.com website disclosing dimensions of a 3mm LED: https://www.electron.com/led-3mm-yellow-amber-hebei-330my8c-p90/.

* cited by examiner

*Primary Examiner* — Eugene L Kim
*Assistant Examiner* — Christopher Glenn
(74) *Attorney, Agent, or Firm* — Donalb J. Ersler

(57) ABSTRACT

An aluminum lighted nock with an external switch preferably includes a nock body, a light unit, a compression spring and a power source. The nock body preferably includes a string portion and a shank portion extending from one end of the string portion. A string receiver is formed in the other end of the string portion. A battery bore is formed through the shank portion and into the string portion. A light hole is formed through a bottom of the battery bore. The light unit preferably includes a top hat LED, a LED housing and a slide pin, which is slid into the battery bore. The pin battery is pressed into the battery bore. The shank portion is inserted into a nock end of an arrow. The top hat LED is pushed back during a launch of the arrow and creates an electrical connection with the power source.

6 Claims, 4 Drawing Sheets

ALUMINUM LIGHTED NOCK WITH AN EXTERNAL SWITCH

BACKGROUND OF THE INVENTION

1. Cross-References to Related Applications

This is a continuation-in-part application, which takes priority from design patent application No. 29/693,641 filed on Jun. 4, 2019, which takes priority from utility patent application Ser. No. 15/972,260, filed on May 7, 2018, which takes priority from utility patent application Ser. No. 15/196,501, filed on Jun. 29, 2016, now U.S. Pat. No. 10,001,353, issued on Jun. 19, 2018, which claims the benefit of provisional application No. 62/190,896 filed on Jul. 10, 2015. The above patent and all of the above patent applications are hereby incorporated by reference in their entirety into this patent application.

2. Field of the Invention

The present invention relates generally to archery and more specifically to an aluminum lighted nock with an external switch, which includes a nock body fabricated from aluminum material.

3. Discussion of the Prior Art

U.S. Pat. No. 8,758,177 to Minica discloses a device and method for illuminating an arrow nock. Patent publication no. 2013/0267359 to Pedersen discloses a self-centering nock. Patent publication no. 2014/0121045 to Minica discloses a device and method for illuminating an arrow nock. However, lighted arrow nocks made from a clear plastic material frequently prematurely break. Once the nock body breaks, the lighted arrow nock must be discarded.

Accordingly, there is a clearly felt need in the art for an aluminum lighted nock with an external switch, which includes a nock body fabricated from an aluminum material instead of an easily broken clear plastic nock body.

SUMMARY OF THE INVENTION

The present invention provides a lighted nock with an external switch, which includes an elongated light emitting device. The lighted nock with an external switch (lighted nock) preferably includes a nock body, a light unit, a compression spring and a power source. The power source is preferably a pin battery. The nock body preferably includes a string portion and a shank portion extending from one end of the string portion. A string slot is formed in the other end of the string portion. A first pair of opposing notches are formed in opposing sides of the string slot in substantially a middle of a length of the string slot. A second pair of opposing notches are formed near an end of the string slot. A battery bore is formed through the shank portion and into the one end of the string portion. An LED body cavity extends into the string portion from an end of the battery bore. A light hole is formed through an end of the string slot, and into an end of the LED body cavity. A switch opening is formed through a wall of the nock body and into battery bore.

The light unit preferably includes a modified top hat type of LED, an LED housing, an LED housing insert and a switch. The modified top hat type of LED includes an elongated light emitting portion, a base portion, a straight electrical lead and a bent electrical lead. The elongated light emitting portion extends from one end of the base portion and the pair of electrical leads extend from an opposing end of the base portion. The LED housing includes a round outer perimeter and an insert notch formed in substantially a middle of a length of the LED housing to receive the LED housing insert. As a result of the insert notch, a first end plate and a second end plate are formed. A pair of lead holes are formed through the first end plate. A lead hole and a bent lead opening are formed through the second end plate. A terminal bore is formed in the second end plate to receive a positive terminal of the pin battery. The LED housing insert includes a half round cylinder and a switch notch formed in one end thereof. The switch includes a switch base and a pair of snap legs. The pair of snap legs extend from the switch base. A distal end of each snap leg is terminated with a snap flange. A distance between the switch base and a bottom of the snap flange is sized to slidably receive a thickness of the LED housing insert.

The light unit is preferably assembled by inserting the two electrical leads through the lead holes and opening in the first and second end plates of the LED housing. The LED housing insert is inserted into the insert notch and the LED housing insert is retained in the insert notch with any suitable device or method. The light unit is then pushed into the battery bore and the LED body cavity. The switch is inserted into switch opening and switch notch, until the snap flanges snap into the LED housing and the LED housing insert. Preferably, the compression spring is inserted into the battery bore. The pin battery is pressed into the battery bore, such that a positive terminal thereof contacts the bent electrical lead, when switch unit is powering the modified top hat type of LED. The modified top hat type of LED will emit light when the switch is toggled to the on position, which causes the bent electrical terminal to contact the positive battery terminal. The shank portion is ready to be inserted into an arrow shaft.

An aluminum lighted nock with an external switch (aluminum lighted nock) preferably includes a nock body, a light unit, a compression spring and a power source. The power source is preferably a pin battery. Aluminum is the preferred metal, but other suitable metals could also be used instead of aluminum. The nock body preferably includes a string portion and a shank portion extending from one end of the string portion. A string receiver is formed in the other end of the string portion. A battery bore is formed through the shank portion and into the string portion. A light hole is formed through a bottom of the battery bore and through the string receiver. A switch opening is formed through a side wall of the nock body and into the battery bore. At least one light opening is formed through the side wall of the nock body and into the battery bore, such that light from the light unit shines out of the nock body.

The light unit preferably includes a top hat type of LED, an LED housing and a slide pin. The modified top hat type of LED includes an elongated light emitting portion, a base portion, a first electrical lead and a second electrical lead. The elongated light emitting portion extends from one end of the base portion and the pair of electrical leads extend from an opposing end of the base portion. The elongated light emitting portion acts as a light source and a plunger for axially moving the light unit within the battery bore. A length of the base portion is about the same length as the elongated light emitting portion. A width of the base portion is at least one and one quarter greater than diameter of the elongated light emitting portion. A thickness of the base portion is about the same as a diameter of the elongated light emitting portion.

The LED housing includes a round outer perimeter and a cross hole that is sized to receive and the slide pin. A The second electrical lead is preferably offset to be routed into the power hole. The LED housing is preferably created by over-molding the first and second electrical leads with a plastic material. The power hole is formed in one end of the LED housing and through a middle thereof to receive the second electrical lead and a pin terminal of the pin battery. An end of the first electrical lead is located in a first electrical lead hole. The spring projection is pressed into the first electrical lead hole to make contact with the first electrical lead. The light unit with the compression spring is then pushed into the battery bore.

The light unit with the compression spring is then pushed into the battery bore. The LED housing must be aligned with the switch hole in the nock body, such that the slide pin may be inserted into the cross hole in the LED housing. The slide pin is inserted into the cross hole. The slide pin is slid toward the string receiver. The pin battery is pressed into the battery bore. The compression spring will create an electrical connection between the first electrical lead and the metal case of the pin battery. The metal case of the pin battery is a ground of the battery. The shank portion is inserted into a nock end of an arrow. The second electrical lead in the pin hole of the LED housing is sized to receive a pin projection of the pin battery. The pin projection is the positive lead of the pin battery. When an arrow is launched from a bow or crossbow, the top hat type of LED is pushed back, which then makes contact with the pin projection of the pin battery. The top hat type of LED is pushed back during a string of a bow during a launch of the arrow and creates an electrical connection between the second lead of the top hat type of LED and the positive terminal of the pin battery. The top hat type of LED emits light, because the electrical circuit is closed. Light is also emitted through the at least one light opening.

Accordingly, it is an object of the present invention to provide a lighted nock with an external switch, which allows the power to be actuated without a tool and which includes an elongated light emitting device.

Finally, it is another object of the present invention to provide an aluminum lighted nock, which includes a slide pin for turning off the light and a nock body made from aluminum, which is stronger than clear plastic.

These and additional objects, advantages, features and benefits of the present invention will become apparent from the following specification.

DETAILED DESCRIPTION OF THE PREFERRED EMBODIMENTS

Figure 1:
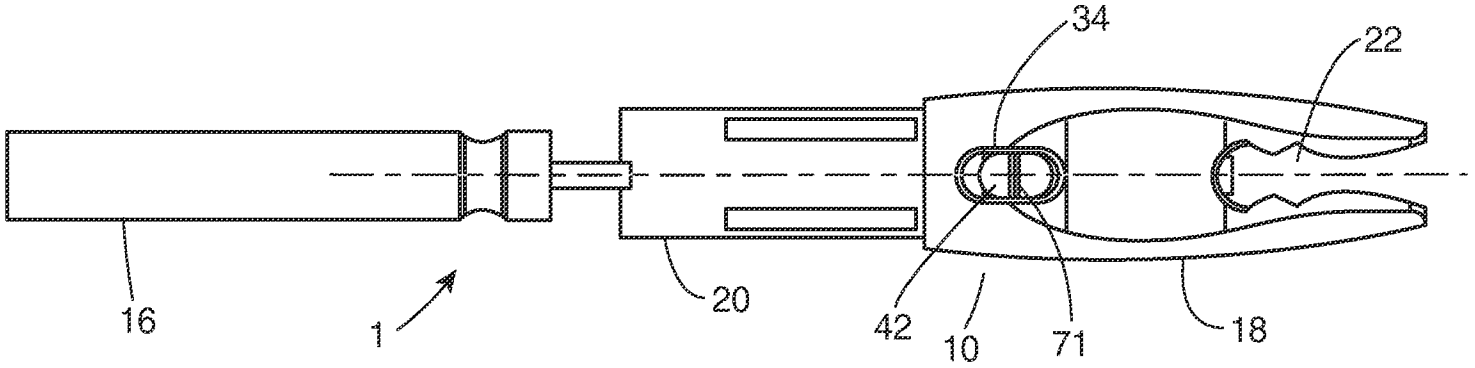
FIG. 1 is a top partially perspective view of a lighted nock before insertion of a pin battery in accordance with the present invention.
Figure 2:
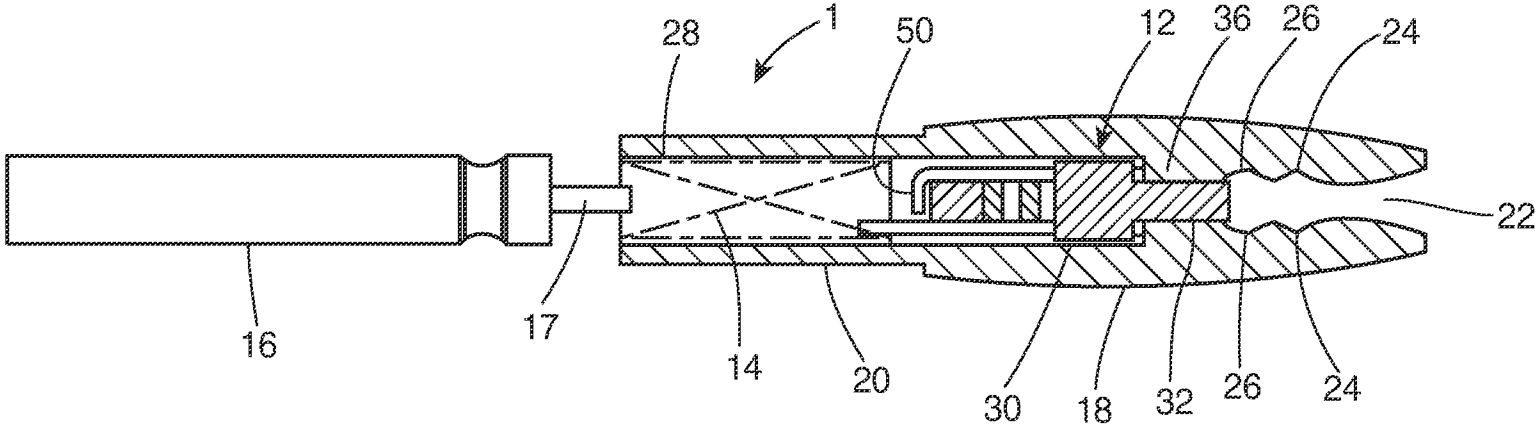
FIG. 2 is a top partially perspective cross sectional view of a lighted nock before insertion of a pin battery in accordance with the present invention.

With reference now to the drawings, and particularly to FIG. 1, there is shown a top partially perspective view of a lighted nock 1 before insertion of a pin battery 16. With reference to FIG. 2, the lighted nock 1 preferably includes a nock body 10, a light unit 12, a compression spring 14 and a power source. The power source is preferably a pin battery 16. The nock body 10 preferably includes a string portion 18 and a shank portion 20, which extends from one end of the string portion 18. A string slot 22 is formed in an opposing end of the string portion 18. A first pair of opposing notches 24 are formed in opposing sides of the string slot 22 in substantially a middle of a length of the string slot 22. A second pair of opposing notches 26 are formed near an end of the string slot 22. A battery bore 28 is formed through the shank portion 20 and into the one end of the string portion 18. An LED body cavity 30 extends into the string portion 18 from a bottom of the battery bore 28. A light hole 32 is formed through an end of the string slot 22 and into the LED body cavity 30. A switch opening 34 is formed through a wall of the nock body 10 and into the battery bore 28.

Figure 4:
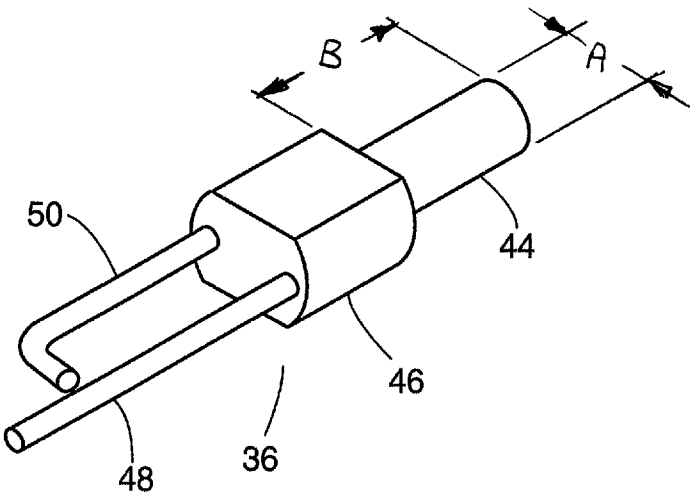
FIG. 4 is a reverse perspective view of an LED housing of a light unit of a lighted nock in accordance with the present invention.
Figure 4:
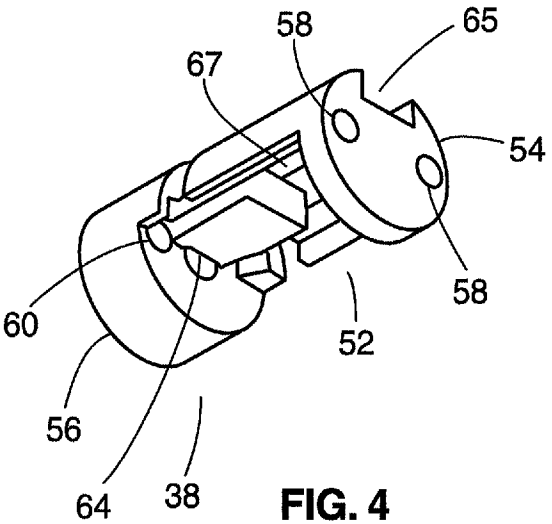
Figure 3:
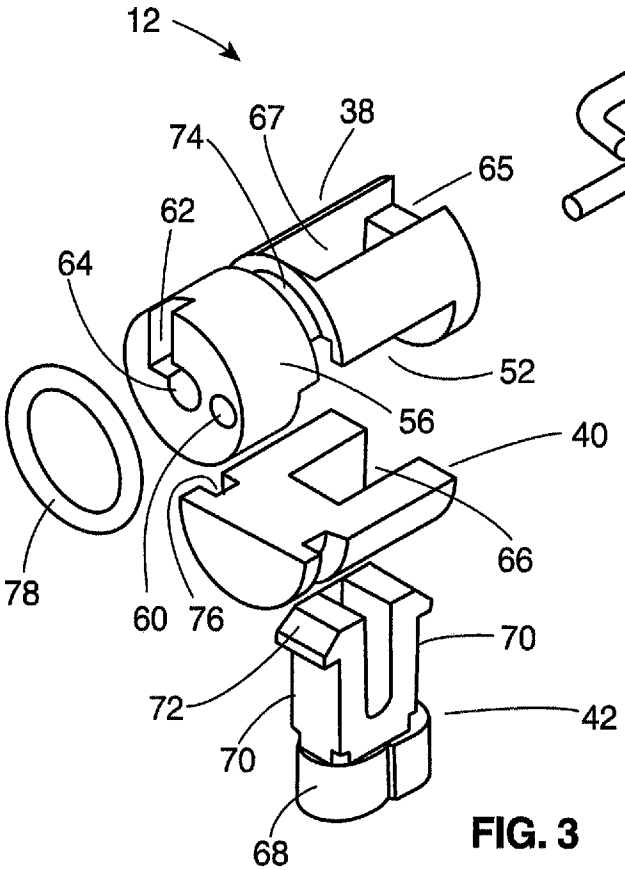
FIG. 3 is an exploded perspective view of a light unit of a lighted nock in accordance with the present invention.
Figure 5:
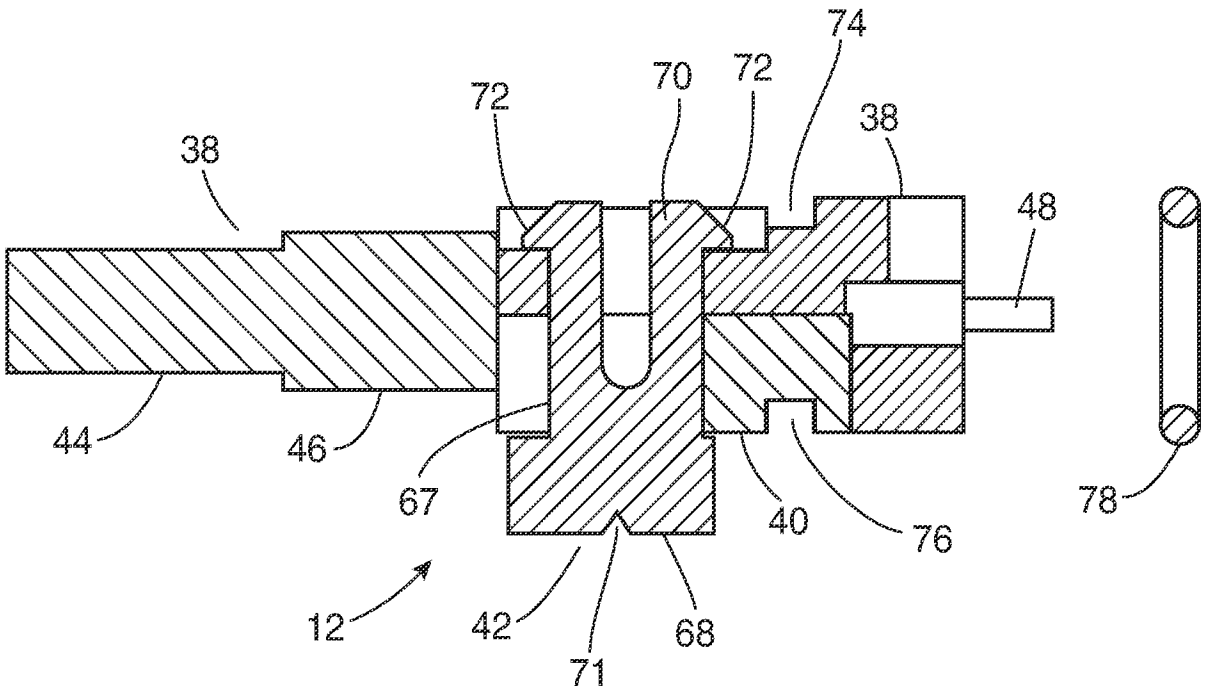
FIG. 5 is a partially exploded cross sectional view of a light unit of a lighted nock in accordance with the present invention.

With reference to FIGS. 3-5, the light unit 12 preferably includes a modified top hat type of LED 36, an LED housing 38, an LED housing insert 40 and a switch 42. The modified top hat type of LED 36 includes an elongated light emitting portion 44, a base portion 46, a straight electrical lead 48 and a bent electrical lead 50. A height of the base portion 46 is substantially the same as a length of the elongated light emitting portion 44. The base portion 46 includes a substantially oval perimeter shape. A light emitting device is located in the base portion 46. The elongated light emitting portion 44 extends from one end of the base portion 46 and the pair of electrical leads 48, 50 extend from an opposing end of the base portion 46. The elongated light emitting portion 44 includes a cylindrical shape. The elongated light emitting portion 44 acts as a light source and a plunger for axially moving the light unit 12 within the battery bore 28. The elongated light emitting portion 44 includes a diameter A and a length B. Where dimension B has a length, which is at least twice the diameter of dimension A. The following dimensions are given by way of example and not by way of limitation. Dimension A is about 0.78 inches and dimension B is about 0.175 inches. However, other dimension may also be used. A typical 3 mm LED is cannot be used as a plunger, because it does have enough strength to take impact from an archery bow string. A typical 3 mm LED has a light emitting portion with a length, which is less than twice a diameter of the light emitting portion.

The LED housing 38 includes a round outer perimeter and an insert notch 52 formed in substantially a middle of a length of the LED housing 38 to receive the LED housing insert 40. However, the LED housing 38 and the LED housing insert 40 may be fabricated from a single piece of material to form a LED housing switch retainer. As a result of the insert notch 52, a first end plate 54 and a second end plate 56 are formed. A pair of lead holes 58 are formed through the first end plate 54. A lead hole 60 and a bent lead opening 62 are formed through the second end plate 56. A terminal bore 64 is formed in the second end plate 56 to receive a positive terminal 17 of the pin battery 16. A switch groove 65 is formed in a top of the LED housing 38. A switch clearance slot 67 is formed through the LED housing 38, adjacent the first end plate 54.

The LED housing insert 40 includes a half round cylinder and a switch notch 66 formed in one end thereof. The switch 42 includes a switch base 68 and a pair of snap legs 70. The pair of snap legs 70 extend from the switch base 68. A toggle slot 71 is preferably formed in a top of the switch base 68. A distal end of each snap leg 70 is terminated with a snap flange 72. The switch unit 12 be toggled between on and off positions by a user by moving the switch 42. A distance between the switch base 68 and a bottom of the snap flange 72 is sized to slidably receive a thickness of the LED housing insert 40. A semi-circular o-ring groove 74 is formed in the LED housing 38, adjacent the second end plate 56 and a semi-circular o-ring groove 76 is formed in the LED housing insert 40 to receive an o-ring 78. The o-ring 78 keeps the light unit 12 assembled outside the battery bore 28 and also provides resistance to axial movement within the battery bore 28.

The light unit 12 is preferably assembled by inserting the two electrical leads 48, 50 through the lead holes 58, 60 and opening 62 in the first and second end plates 54 of the LED housing. The LED housing insert 40 is inserted into the insert notch 52 and the LED housing insert 40 is retained in the insert notch 52 with the o-ring 78 or any other suitable device or method. The light unit 12 is then pushed into the battery bore 28 and the LED body cavity 30. The switch 42 is inserted into switch opening 34 and the switch notch 66, until the snap flanges 72 of the switch 42 snap into the LED housing 38 and the LED housing insert 40.

Preferably, the compression spring 14 is inserted into the battery bore 28. The pin battery 16 is pressed into the battery bore 28, such that a positive terminal 17 thereof contacts the bent electrical lead 50, when switch unit 12 is powering the modified top hat type of LED 36. The modified top hat type of LED 36 will emit light when the switch 42 is toggled to the on position, which causes the bent electrical terminal 50 to contact the positive battery terminal 17. The electrical lead 48 will make electrical contact with the grounded case of the pin battery 16. The shank portion 20 is ready to be inserted into an arrow shaft (not shown). A bow string of a archery bow (not shown) is inserted into the string slot 22, until the bow string is retained in the first pair of opposing notches 24. The bow string is pulled back and released, which causes the bow string to go into the second pair of opposing notches 26. The bow string toggles the light unit 12 through the elongated light emitting portion 44, such that the battery terminal 17 contacts the electrical lead 50 and causes electrical current to flow into the modified top hat type of LED 36 and emit light.

Figure 6:
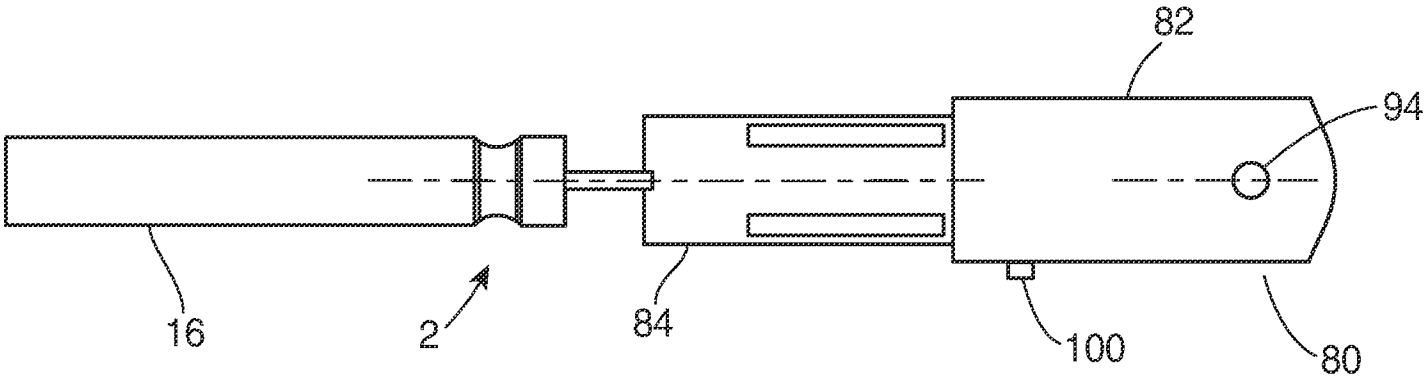
FIG. 6 is a top partially exploded view of an aluminum light nock in accordance with the present invention.
Figure 7:
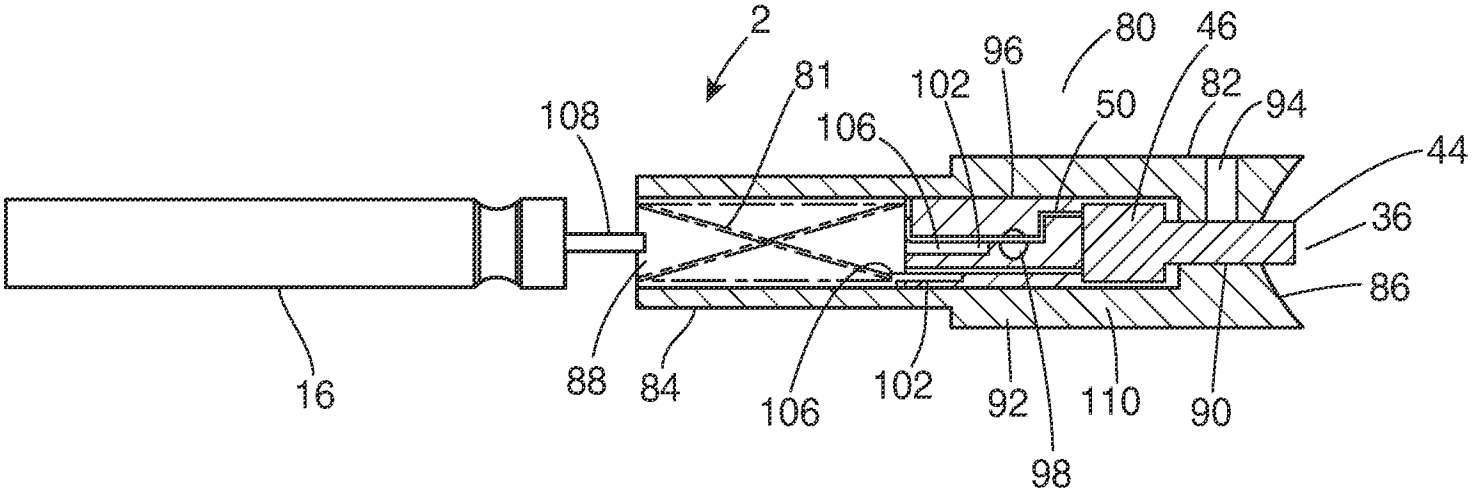
FIG. 7 is a side partially exploded cross sectional view of an aluminum light nock in accordance with the present invention.

With reference to FIGS. 6-7, an aluminum lighted nock with an external switch (aluminum lighted nock) 2 preferably includes a nock body 80, the modified top hat type of LED 36, a compression spring 81 and a power source. Aluminum is the preferred metal for the nock body 80, but other suitable metals could also be used instead of aluminum. The power source is preferably the pin battery 16. The nock body 80 preferably includes a string portion 82 and a shank portion 84 extending from one end of the string portion 82. A string receiver 86 is formed in the other end of the string portion 82. A battery bore 88 is formed through the shank portion 84 and into the string portion 82. A light hole 90 is formed through a bottom of the battery bore 88 and into the string receiver 86. A switch opening (not shown) is formed through a side wall 92 of the nock body 80 and into the battery bore 88. At least one light opening 94 is formed through the side wall 92 of the nock body and into the light hole 90, such that light from the elongated light emitting portion 44 shines out of the nock body 80.

The modified top hat type of LED 36 preferably includes an elongated light emitting portion 44, the base portion 46, the first electrical lead 48 and the second electrical lead 50. The elongated light emitting portion 44 extends from one end of the base portion 46 and the pair of electrical leads 48, 50 extend from an opposing end of the base portion. The elongated light emitting portion 44 acts as a light source and a plunger for axially moving the modified top hat type of LED 36 within the battery bore. A length of the base portion 46 is about the same length as the elongated light emitting portion 44. A width of the base portion 46 is at least one and one quarter (1¼) greater than a diameter of the elongated light emitting portion 44. A thickness of the base portion 46 is about the same as the elongated light emitting portion 44.

A LED housing 96 includes a round outer perimeter and a cross hole 98 that is sized to receive a slide pin 100. A pin power hole 102 is formed in one end of the LED housing 96. The second electrical lead 50 is preferably offset to be routed into the pin power hole 102. The LED housing 96 is preferably created by over-molding the first and second electrical leads 48, 50 with plastic. The pin power hole 102 is formed through a middle of the LED housing 96 to receive the second electrical lead 50 and a pin terminal 108 of the pin battery 16. A spring projection 106 extending from the compression spring 81 is pressed into a first electrical lead hole 104. A light unit 110 includes the top hat type of LED 36 and LED housing 96. The light unit 110 with the compression spring 81 is then pushed into the battery bore 88.

The LED housing 96 must be aligned with the switch hole in the nock body 80, such that the slide pin 100 may be inserted into the cross hole 98 in the LED housing 96. The slide pin 100 is inserted into the cross hole 98. The slide pin 100 is slid toward the string receiver 86. The pin battery 16 is pressed into the battery bore 88. The compression spring 81 will create an electrical connection between the first electrical lead 48 and the metal case of the pin battery 16. The metal case of the pin battery 16 is acts as a ground. The shank portion 84 is inserted into a nock end of an arrow. The second electrical lead 50 in the pin power hole 102 of the LED housing 96 is sized to receive the pin projection 108 of the pin battery 16. The pin projection 108 is the positive lead of the pin battery 16. When an arrow is launched from a bow or crossbow, the modified top hat type of LED 36 is pushed back, which then makes contact with the pin projection 108 of the pin battery 16. The modified top hat type of LED 36 is pushed back during a launch of the arrow by a bowstring and creates an electrical connection between the second lead 50 of the modified top hat type of LED 36 and the positive terminal of the pin battery 16. The elongated light emitting portion 44 of the modified top hat type of LED 36 emits light, because the electrical circuit is closed. Light is also emitted through the at least one light opening 94.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A metal lighted nock with an external switch comprising:

a nock body includes a string portion and a shank portion, said shank portion extends from said string portion, a string receiver is formed in said string portion, a battery bore is formed through said shank portion into said string portion, said nock body is fabricated from a metal material, a switch opening is formed through a sidewall of said nock body and communicates with said battery bore;

a light unit includes a top hat type of LED, an LED housing and a slide pin, said top hat type of LED includes an elongated light emitting portion, a base portion, a first electrical lead and a second electrical lead, said elongated light emitting portion extends from one end of said base portion, said first and second electrical leads extend from an opposing end of said base portion, said first and second electrical leads are retained in said LED housing, a height of said base portion is about the same length as a length of said elongated light emitting portion, a light hole is formed through a bottom of said battery bore to slidably receive said elongated light emitting portion, wherein said LED housing is inserted into said battery bore, said slide pin is inserted into a hole in said LED housing through said switch opening; and a battery having a grounded case and a positive terminal is pressed into said battery bore, wherein said top hat type of LED is moved to make an electrical connection between said grounded container and said positive terminal to illuminate said top hat type of LED.

2. The metal lighted nock of claim 1 wherein:

a width of said base portion is at least one and one quarter greater than a diameter of said elongated light emitting portion.

3. The metal lighted nock of claim 1 wherein:

a thickness of said base portion is about the same as a diameter of said elongated light emitting portion.

4. The metal lighted nock of claim 1 wherein:

a compression spring is used to make an electrical connection between said first electrical lead and said grounded case.

5. The metal lighted nock of claim 1 wherein:

at least one light hole is formed through a side wall of said nock body, adjacent said elongated light emitting portion.

6. The metal lighted nock of claim 1 wherein:

said LED housing is molded over said first and second electrical leads with plastic.

* * * * *